US005388281A

United States Patent [19]

Wiklund et al.

[11] Patent Number: 5,388,281

[45] Date of Patent: Feb. 14, 1995

[54] AUTOMATIC CLOSURE MECHANISM FOR A TOILET SEAT

[76] Inventors: Ken Wiklund, 29 Ruskin Row, Winnipeg, Manitoba, R3M 2R9; Tim Seniuk, 5715 Roblin Blvd., Winnipeg, Manitoba, R3G 1M2, both of Canada

[21] Appl. No.: 127,149

[22] Filed: Sep. 27, 1993

[51] Int. Cl.[6] ..... A47K 13/04

[52] U.S. Cl. ..... 4/248; 4/246.2

[58] Field of Search ..... 4/246.1, 246.2, 248; 16/54, 58; 188/306, 307

[56] References Cited

U.S. PATENT DOCUMENTS

| | | | |
|---|---|---|---|
| Re. 18,389 | 3/1932 | Mitchell | 16/58 X |
| 617,479 | 1/1899 | Damitz | 16/58 |
| 1,333,040 | 3/1920 | Schwantes | 16/58 X |
| 2,781,177 | 2/1957 | Petersen | 188/306 X |
| 2,814,049 | 11/1957 | Mercur | 4/241 |
| 3,404,411 | 10/1968 | Newkirk | 4/246.1 |
| 3,781,924 | 1/1974 | Davis, Jr. | 4/246.2 |
| 4,477,933 | 10/1984 | Leckie | 4/253 |
| 4,491,989 | 1/1985 | McGrail | 4/246.1 |
| 4,575,879 | 3/1986 | Cabral et al. | 4/253 |
| 4,766,619 | 8/1988 | Takeda | 4/246.1 |
| 4,912,783 | 4/1990 | Shafer | 4/246.1 |
| 4,914,757 | 4/1990 | Johnson | 4/246.1 X |
| 4,951,323 | 8/1990 | Shalom | 4/246.1 |
| 4,982,453 | 1/1991 | Matsumoto | 4/248 |
| 4,995,120 | 2/1991 | Tager | 4/246.1 |
| 5,010,601 | 4/1991 | Kobayashi et al. | 4/236 |
| 5,058,216 | 10/1991 | Trayer et al. | 4/246.2 |
| 5,060,318 | 10/1991 | Jaskiewicz | 4/246.3 |
| 5,101,518 | 4/1992 | Phillips | 4/246.2 |
| 5,153,946 | 10/1992 | Yoke et al. | 4/248 |
| 5,193,228 | 3/1993 | Murasawa et al. | 4/236 |
| 5,279,000 | 1/1994 | Mercier et al. | 4/248 X |

FOREIGN PATENT DOCUMENTS

| | | | |
|---|---|---|---|
| 0774241 | 5/1957 | United Kingdom | 16/58 |

*Primary Examiner*—Robert M. Fetsuga

*Attorney, Agent, or Firm*—Henderson & Sturm

[57] ABSTRACT

An automatic closure mechanism, particularly adapted for use with a toilet seat is described. The mechanism will automatically lower a toilet seat that has been rotated to a raised position after a time interval determined by the viscosity of a damper fluid in a dashpot of the mechanism. The mechanism is simply constructed and preferably integral with a rear edge of the toilet seat so that it provides a clean, neat appearance which is aesthetically pleasing and does not interfere with cleaning or maintenance of the toilet fixture. The mechanism includes a dry coil spring section and a hydraulic dashpot section. The dashpot includes a primary flap valve and a relief flap valve which permit the toilet seat to be raised with very little resistance and automatically returned to a lowered position after about 1-5 minutes, depending on the viscosity of the damper fluid in the dashpot. The automatic closure may be overridden to forcibly return the seat to the lowered position in an emergency situation without damage to the seat or the closure mechanism. The advantages include a simple, economic construction, a neat appearance, and a robust closure mechanism which cannot be damaged by a manual override of the closure damper.

16 Claims, 6 Drawing Sheets

AUTOMATIC CLOSURE MECHANISM FOR A TOILET SEAT

TECHNICAL FIELD

The present invention relates to apparatus for closing toilet seats and, in particular, to a novel automatic closure mechanism for controllably closing a toilet seat while permitting the seat to be forcibly urged to a lowered position without damaging the seat or the closure mechanism.

BACKGROUND OF THE INVENTION

Toilet seats are a common cause of irritation in households where men and women share a bathroom equipped with a toilet fixture. Men must raise the toilet seat in order to use the toilet for urination. Women, however, use the toilet seat in its lowered position. Women are, therefore, often frustrated by finding the toilet seat in a raised position. This experience can be particularly frustrating and potentially hazardous when someone attempts to use the toilet in a sitting position in a dark or poorly lit room.

Considerable inventive ingenuity has been directed towards the development of apparatus for either closing toilet seats automatically and/or damping the descent of a toilet seat so that it closes without noise or damage to the seat or the toilet bowl.

Much of the prior art relates to bulky apparatus which clutters the toilet area with cylinders, electrical wires, hoses or other paraphernalia used to control the opening and/or closing of the seat or lid. Such paraphernalia is not only unattractive and difficult to clean, it can also represent a hazard which can potentially cause accidental tripping and the like.

More aesthetic and compact mechanisms for damping the closure of a toilet seat or automatically closing and damping the closure of a toilet seat have also been invented. One such mechanism is described in U.S. Pat. No. 5,153,946 which issued Oct. 13, 1992 to Yoke et al. This patent is entitled APPARATUS AND METHOD FOR AUTOMATICALLY CLOSING A TOILET BOWL LID AND SEAT and describes an apparatus that includes a control mechanism engageable with a toilet bowl lid for locking the lid in the open position after the lid is pivoted to the open position, and a timer mechanism for actuating the control mechanism to release the lid from the open position after a predetermined time interval. The timer mechanism is suspended while at least a predetermined weight is applied to the seat in a lowered position. The apparatus further includes a damper mechanism to retard the descent of the lid after the lid is urged to the closed position by the action of a coil spring when the predetermined time interval has expired.

U.S. Pat. No. 5,193,228 which issued Mar. 16, 1993 to Murasawa et al is entitled TOILET COVERING HINGE ASSEMBLY WITH DAMPING CAPABILITY. This patent describes a hinge assembly for a toilet cover designed to dampen the motion of a toilet cover when it is moved from a raised to a lowered position. The assembly includes a hinge shaft connecting the toilet cover to the rear of the toilet so that it is rotatable together with the toilet cover between the lowered and raised positions. Connected to the hinge shaft is a dashpot which is secured on the side of the toilet and includes a cylinder containing a volume of damper fluid and a rotor rotatably received within the cylinder. The rotor receives the hinge shaft to be rotatable together therewith and is provided with a flap extending outwardly into the damper fluid. The flap is pivotable relative to the rotor so that the flap is caused to pivot to a folded condition when the seat cover is raised so that there is substantially no resistance to the upward movement of the cover. When the cover is manually released from an open position, however, the flap pivots to an unfolded position and resists movement of the damper fluid so that the cover descends slowly to the closed position.

The shortcoming in each of these apparatus is that although both mechanisms are relatively unobtrusive and aesthetic in their appearance, neither mechanism appears to accommodate a manual override of the damper mechanism to permit a forced lowering of a toilet seat. Emergency situations arise wherein use of a toilet becomes urgent. In such situations, if a toilet seat is open or only partially closed, it is not necessarily practical or possible to wait until the seat descends to a fully lowered position, which generally takes half a minute or so. Since no provision is made for forcibly closing the seats described above, a forced closure could damage the damper mechanism and/or the toilet seat or hinge assembly. A severe increase in fluid pressure created by a manual override of the damper mechanism could also damage the seals and/or the flap valve in these mechanisms.

SUMMARY OF THE INVENTION

It is an object of the invention to overcome the shortcomings of the prior art by providing an aesthetic, reliable and unobtrusive automatic closure mechanism for a toilet seat.

It is a further object of the invention to provide an automatic closure for a toilet seat which is readily and economically manufactured.

It is yet a further object of the invention to provide an automatic closure for a toilet seat which mounts directly to a standard toilet fixture without additional hardware.

In accordance with a first aspect of the invention there is provided a dashpot mechanism with damping capability for controlling the movement of a hinge that supports a pivotable member, such as a cover assembly, to permit, e.g., the cover, to be pivoted, e.g., from an original position, to a second or raised position with little resistance while ensuring that the cover returns towards the original position or to a lowered position in a controlled fashion unless the controlled returning or closing action is overridden, in which case the return of the member or closure may be forcibly returned to the original or a closed condition without damaging either of the dashpot and the member or cover assembly:

Accordingly, the present invention is directed to a dashpot mechanism with damping capability for controlling the movement of a pivotable cover assembly to permit the cover to be pivoted to a raised position with little resistance while ensuring that the cover returns to a lowered position in a controlled fashion unless the controlled closing action is overridden, in which case the closure may be forcibly returned to a closed condition without damaging either of the dashpot and the cover assembly, includes:

a stator and a cylindrical rotor rotatably received on the stator, the rotor being connectable to the cover assembly for rotation therewith, the cylinder defining a fluid tight reservoir and the reservoir containing a damper fluid;

first and second spaced-apart flap valves positioned in the reservoir to define first and second fluid chambers, wherein the first valve is mounted to an inner wall of the rotor, the first valve having a free edge and being adapted to rotate between a closed condition wherein the free edge contacts a wall of the stator and an open condition wherein the free edge is spaced from the wall of the stator, the second valve is mounted to the wall of the stator, the second valve being adapted to rotate between a closed condition wherein a free edge of the valve is adjacent the wall of the rotor to an open condition wherein the free edge is spaced from the wall of the rotor; and means for respectively urging the first and second valves to their closed conditions, whereby when the closure assembly is pivoted to the raised position, the first flap valve is forced by fluid pressure generated in the damper fluid to an open condition and the cover may be raised with little resistance, and when the cover assembly is moved toward a lowered position the first and second flap valves resist movement of the damper fluid and the closure movement of the cover is resisted so that the cover lowers in a controlled manner, but when the cover is forced to a lowered position by a manual override, the fluid pressure degenerated in the damper fluid by the forced closure movement forces the second flap valve to the open condition and the cover may be forcibly lowered with little additional resistance and without damage to any one of the cover assembly and the dashpot.

In accordance with a further aspect of the invention there is provided an apparatus for automatically closing a seat member for a toilet bowl.

Accordingly, the present invention is directed to an apparatus for automatically closing a seat member for a toilet bowl that includes:

a hollow cylindrical rotor affixable to the seat member for rotation therewith from a lowered position wherein the seat member rests on a top edge of the toilet bowl to a raised position wherein the seat member is at an obtuse angle with respect to the top edge of the toilet bowl;

a stator having opposite ends, the stator extending axially through the rotor and the opposite ends being mountable to brackets for supporting a rear edge of the seat member;

an energy storage means associated with the rotor and the stator for urging the seat member to the lowered position after the seat member has been manually rotated from the lowered position;

means for defining a fluid tight reservoir within a portion of the rotor;

first and second flap valves located in the fluid tight reservoir, the first valve being rotatably mounted to an inside surface of the rotor and the second valve being rotatably mounted to an outer surface of the stator so that the fluid tight reservoir is positioned into first and second fluid chambers when the respective valves are in a closed condition, the first and second valves being respectively provided with means for urging the valves to the closed condition; and a damper fluid filling the first and second fluid chambers, whereby when the seat member is rotated to the raised position, the first valve is forced open by damper fluid pressure and the seat may be rotated to the raised position with little resistance, and when the energy storage means urges the seat member to a lowered position, the seat closes slowly because the flap valves resist movement of the damper fluid, but when the seat member is forced to a lowered position, the second flap valve is forced open by fluid pressure and the seat may be moved to the lowered position with little additional resistance.

Thus, the invention in a first aspect provides a dashpot mechanism for a closure assembly, such as a toilet seat or lid, the dashpot providing a mechanism for damping the closing action of the closure assembly while ensuring that the damping action may be overridden by manual pressure to effect closure of the assembly without undue resistance. In order to provide this capability, the dashpot assembly is constructed from a cylindrical rotor which rotates about an axial stator. A fluid tight reservoir is formed within the cylindrical rotor. Two flap valves mounted within the fluid tight reservoir control the rotation of the rotor. Each flap valve has a top and bottom edge and the bottom edge of each valve is provided with an anchor bulb which is rotatably received in an anchor cavity. The first flap valve is anchored to an inner side wall of the rotor and rotates from an open condition wherein the top edge of the flap valve is adjacent the inner side wall of the rotor to a closed condition wherein the top edge abuts a side wall of the stator. The second flap valve is spaced apart from the first valve and mounted to the stator so that it is rotatable between a closed condition wherein its top edge is adjacent the inner wall of the rotor and a fully open condition wherein its top edge is adjacent the stator. Springs positioned at each end of the respective flap valves urge the flap valves to the closed condition. The springs on the first, or primary flap valve are less robust than the springs on the second, or relief, flap valve. When a hinge member connected to the rotor of the dashpot is rotated as a seat connected to the hinge is rotated to a raised position, the weaker spring of the primary flap valve is overridden by fluid pressure and the primary valve opens to let the fluid flow by the valve so that the seat can be raised with substantially no resistance.

When the seat is moved toward a lowered position past the center of gravity of the seat so that gravity forces the seat closed, the damper fluid flows slowly around the side and ends of the flap valves so that the seat slowly descends to a closed position. If an urgent requirement for the seat occurs, manual pressure may be applied to the seat, in which instance the heavier spring of the relief valve is overridden and the seat may be forced to a lowered position with little further resistance. Thus, the closure damper mechanism is protected from damage and a reliable inexpensively constructed dashpot mechanism is provided.

In accordance with a further aspect of the invention there is provided an automatic closure assembly for a toilet seat which utilizes the dashpot described above in conjunction with a coil spring that urges the seat to a lowered position. When the seat is rotated to the raised position, it rests against the toilet lid at an angle which is past the center of gravity with respect to a pivot point of the seat. Although the energy stored in the coil spring urges the seat to a lowered position, the fluid resistance in the dashpot assembly and the action of gravity retains the seat in the raised position for two to five minutes depending on the viscosity of the fluid in the dashpot. Once the coil spring has rotated the seat past its center of gravity, gravity assists the action of the coil spring to lower the seat to its lowered position on a top edge of the toilet bowl in 10–30 seconds, again depending on the viscosity of fluid in the dashpot. If a seat that has been raised is required by someone who wishes to sit on the toilet, the raised seat can be forced to the lowered position using manual pressure. Manual pressure on the raised seat generates fluid pressure on the relief valve. The fluid pressure forces the relief valve to an open condition and the seat is readily lowered with little further resistance. Therefore, in emergency situations, the seat can be rapidly lowered without damaging the dashpot, the seat, the hinge or the mounting bracket assembly.

Furthermore, the invention provides an automatic closure for a toilet seat which has substantially the same external appearance as a standard toilet seat and is adapted to be mounted to any standard toilet bowl without special fittings. Thus, there is no extraneous apparatus to clutter the toilet and inhibit cleaning or safe movement about the toilet area. While the closure mechanism in accordance with the invention is intended primarily for domestic fixtures, it is equally adapted to use in public washrooms where toilet seats are preferably maintained in a raised position rather than a lowered position. By reversing the orientation of the flap valves and the coil spring, a toilet seat is readily manufactured which normally rests in a raised position and is easily lowered for use. Such a seat will return to the raised position after a time interval which is dependent on the viscosity of the damper fluid in the dashpot mechanism and the strength of the coil spring.

BRIEF DESCRIPTION OF THE DRAWINGS

These and other aspects of the invention will now be more fully explained by way of example only and with reference to the following drawings wherein.

FIGS. *7a–e* are cross-sectional views of the position of the flap valves in a dashpot of the closure assembly in accordance with the invention during a normal operation, wherein:

FIG. *7a* shows the toilet seat in a lowered position;

FIG. *7b* shows the toilet seat being rotated to a raised position;

FIG. *7c* shows the toilet seat in a fully raised position;

FIG. *7d* shows the toilet seat being lowered by the action of the automatic closure; and FIG. *7e* shows the toilet seat returned to the lowered position; and FIGS. *8a–c* are cross-sectional views of the action of the flap valves in the dashpot of the closure assembly when the toilet seat is forcibly returned to a lowered position, wherein:

FIG. *8a* shows the toilet seat in a raised position;

FIG. *8b* shows the toilet seat being forcibly lowered; and

FIG. *8c* shows the toilet seat in a lowered position.

DETAILED DESCRIPTION OF THE PREFERRED EMBODIMENT

Figure 1:
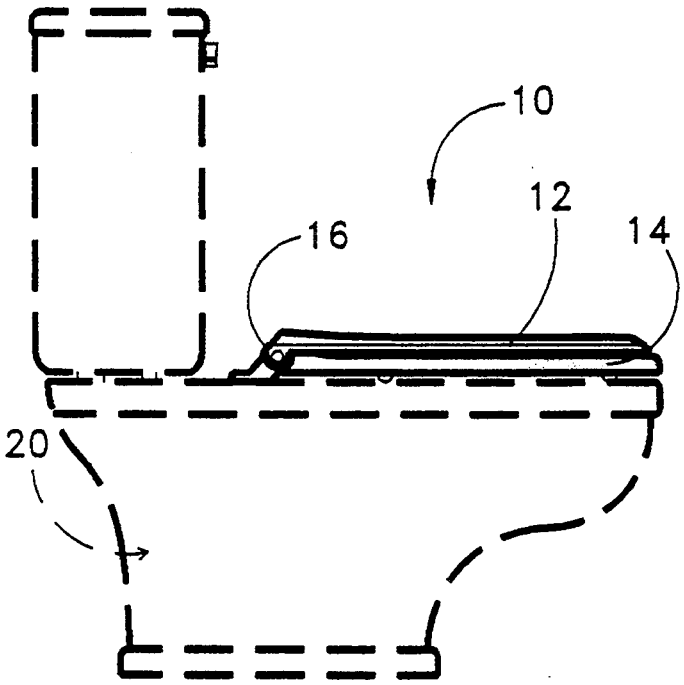
FIG. 1 is a side elevational view of a toilet seat equipped with a closure mechanism in accordance with the invention, the toilet seat being mounted to a standard toilet fixture shown in phantom lines.

FIG. 1 shows a side elevational view of a preferred embodiment of a toilet closure, generally indicated by reference 10, in accordance with the invention. The toilet closure 10 preferably includes a toilet seat cover 12, a toilet seat 14 and a closure mechanism 16, which is preferably an integral component of the toilet seat 14. The toilet seat also includes mounting brackets 18 that are adapted to fit any standard toilet fixture, generally indicated by reference 20 and shown in phantom lines.

Figure 2:
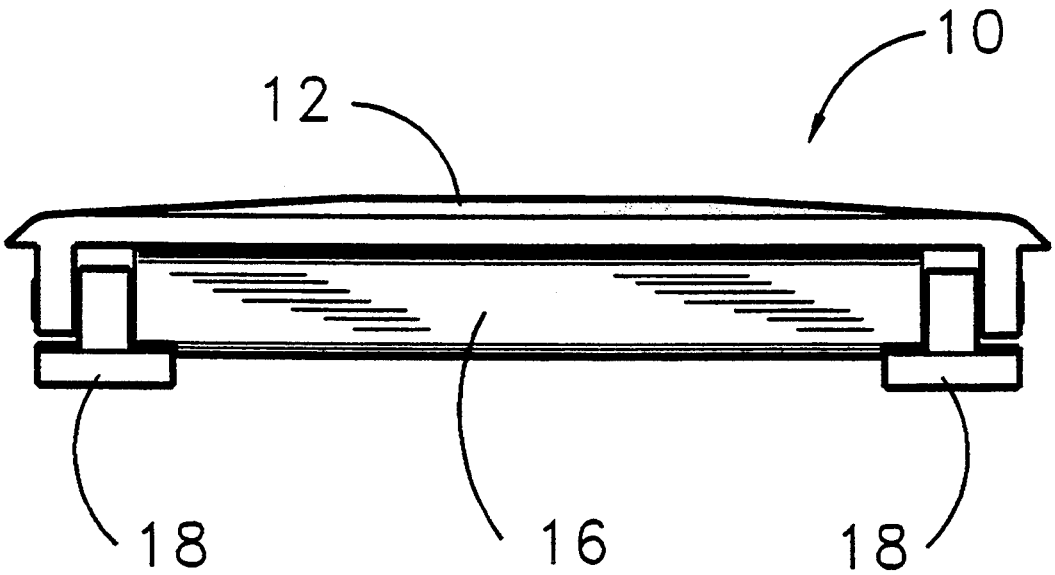
FIG. 2 is a rear elevational view of the toilet seat closure shown in FIG. 1.

FIG. 2 shows a rear elevational view of the toilet closure in accordance with the invention. As is readily apparent, the toilet closure is substantially identical in appearance to a standard toilet closure assembly well known in the art. A distinct advantage of the closure mechanism in accordance with the invention is that it provides an economically manufactured toilet seat that automatically closes after a predetermined time interval.

Figure 3:
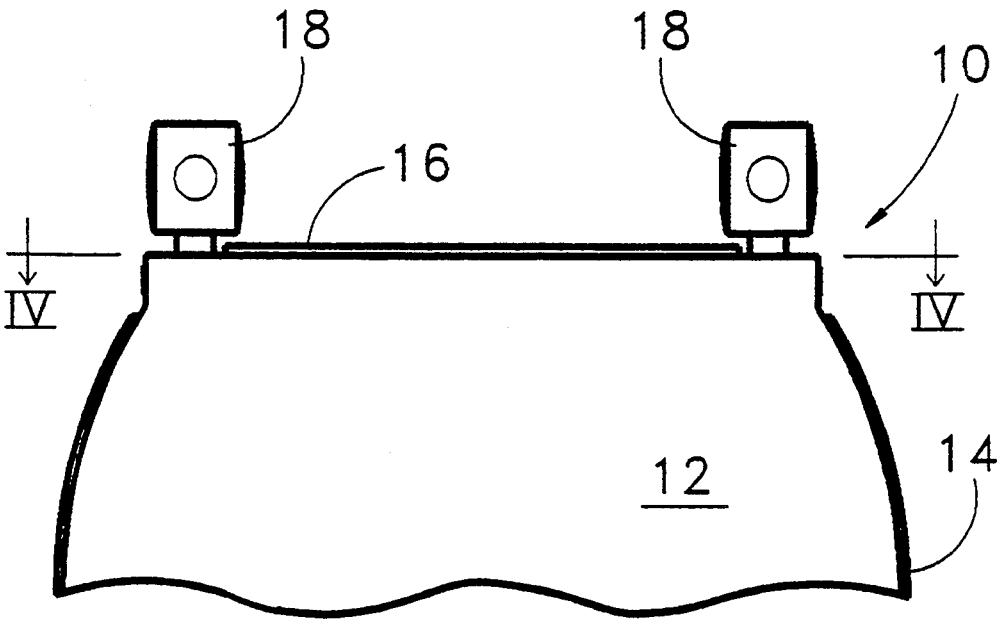
FIG. 3 is a top plan view of a rear portion of the toilet seat shown in FIGS. 1 and 2.

FIG. 3 shows a top elevational view of a rear portion of a toilet closure assembly 10 shown in FIG. 1. It is readily appreciated that the toilet closure assembly 10 in accordance with the invention provides a clean, neat appearance which permits ready access to a toilet fixture 20 for cleaning. The toilet closure assembly 10 also provides an uncluttered, aesthetically pleasing toilet closure assembly.

Figure 4:
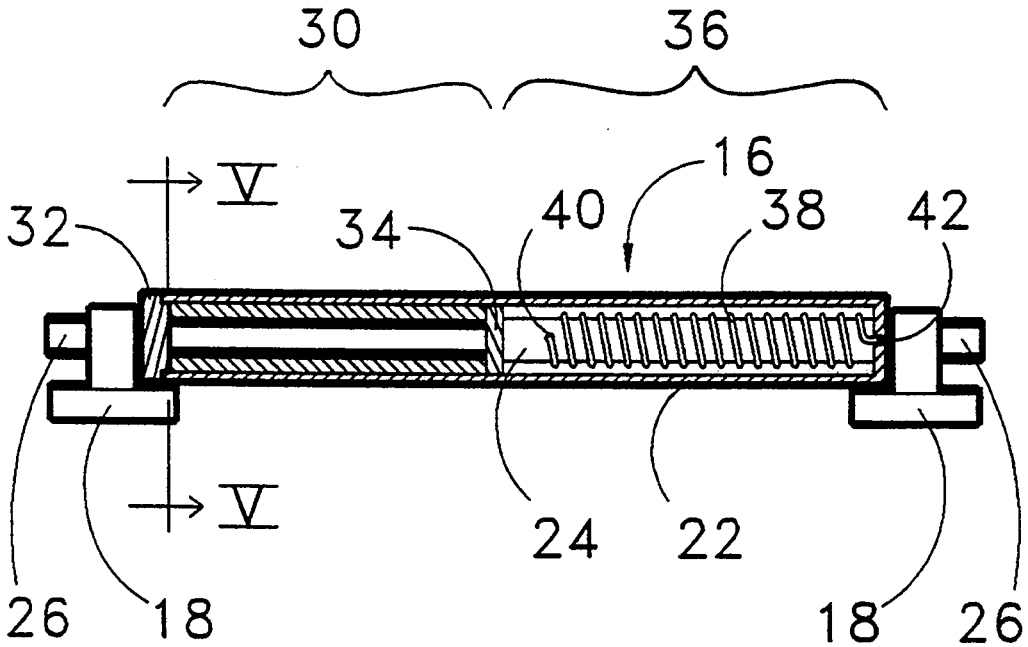
FIG. 4 is a longitudinal cross-sectional view taken along lines IV—IV of FIG. 3.

FIG. 4 shows a longitudinal cross-sectional view of the closure assembly 16, taken along lines IV—IV of FIG. 3. The closure assembly includes a cylindrical rotor 22 which is preferably an integral part of the rear portion of the toilet seat as can be seen in FIGS. 1–3. The closure assembly 16 also includes a stator 24 which is fixedly attached to the mounting brackets 18, as will be explained below in more detail with reference to FIG. 6. Provided on an outer side of each mounting bracket 18 is a hinge pin 26 which provides a pivot for the toilet seat cover 12 (see FIGS. 1–3). The closure assembly 16 is partitioned into a hydraulic section 30, hereinafter referred to as a dashpot 30 and a dry spring section 36. The dashpot 30 is delimited by a dashpot center plate 32 and a dashpot end plate 34. The construction and function of the dashpot 30 is explained in detail below. The dry spring section 36 includes a coil spring 38 which engages a hole 40 in the stator 24 and a hole 42 in the rotor 22. The coil spring 38 stores energy generated when the toilet seat 14 is manually rotated to a raised position. The coil spring, therefore, urges the toilet seat to a lowered position.

Figure 5:
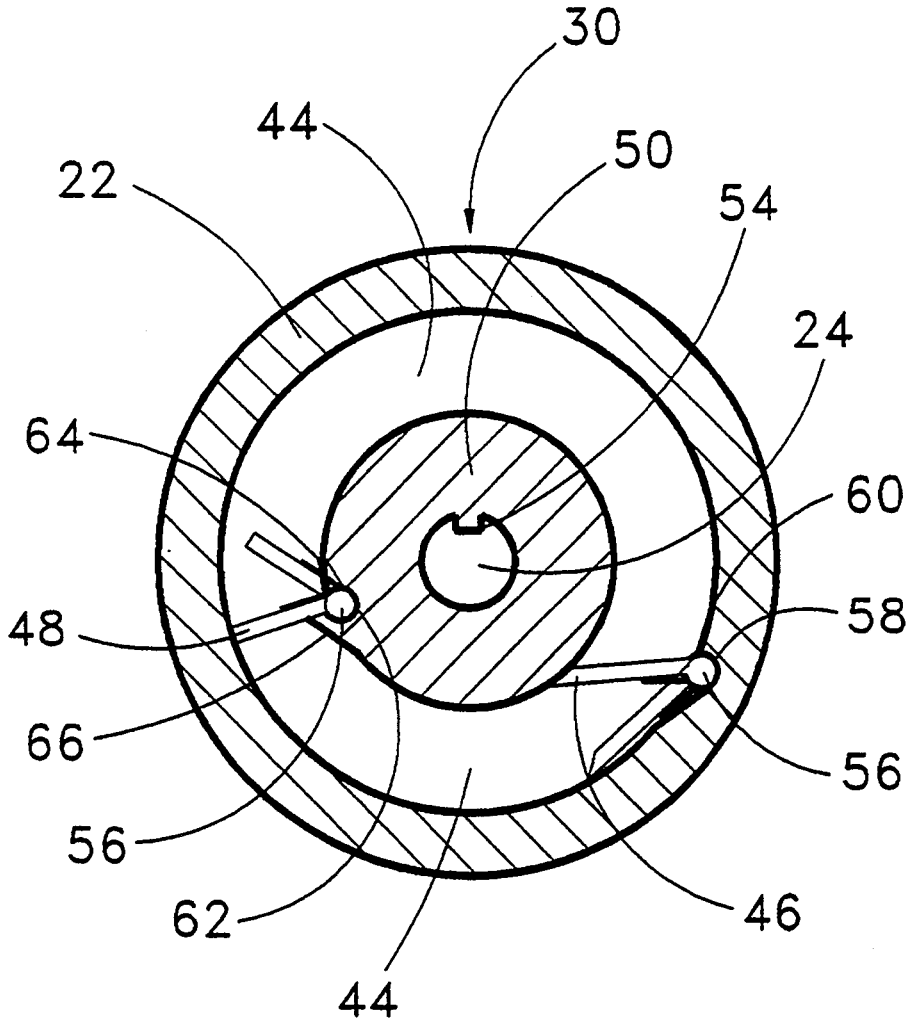
FIG. 5 is an enlarged cross-sectional view taken along lines V—V of FIG. 4.

FIG. 5 shows a cross-sectional view of the dashpot 30 taken along lines V—V of FIG. 4. The dashpot includes two flap valves which extend between the dashpot center plate 32 and the dashpot end plate 34 (see FIG. 4). A first flap valve, hereinafter referred to as the primary valve 46 is mounted to an inner wall of the rotor 22. A second flap valve, hereinafter referred to as the relief valve 48 is mounted to a relief valve mount 50 which is in turn affixed to the stator 24 by an integral key 52 that engages a slot 54 in the stator 24. The relief valve mount 50 defines an edge of stator 24.

Each flap valve 46, 48 is respectively provided with an anchor bulb 56 on a bottom edge thereof. The anchor bulb 56 of the primary valve 46 is received in an anchor cavity 58 formed in an inner wall of the rotor 22. The anchor cavity 58 is shaped to securely retain the primary valve 46 while permitting the primary valve to rotate from a closed condition shown in solid lines where a free edge of the primary valve abuts an edge of the stator 24 defined by the relief valve mount 50, to a fully open condition shown in phantom lines, where the free edge of the primary valve 46 is adjacent the inner wall of the rotor 22. Two torsion springs 60, respectively mounted to each end or sides of the primary valve 46, constantly urge the primary valve to its closed condition. The relief valve 48 is received in an anchor cavity 62 formed in the relief valve mount 50. The anchor cavity 62 is shaped to permit the relief valve 48 to rotate from a closed condition wherein a free edge of the relief valve 48 is adjacent the inner wall of the rotor 22, to a fully open condition shown in phantom lines where the free edge of the relief valve 48 is adjacent an inner edge of the stator 24, defined by the relief valve mount 50. Two torsion springs 64, respectively mounted on opposite ends or sides of the relief valve 48, constantly urge the relief valve to a closed condition. The torsion springs 64 are more robust than the torsion springs 60 on the primary valve 46, the purpose of which will be explained below. A stop 66 associated with the anchor cavity 62 prevents the relief valve 48 from rotating past a closed position.

Figure 6:
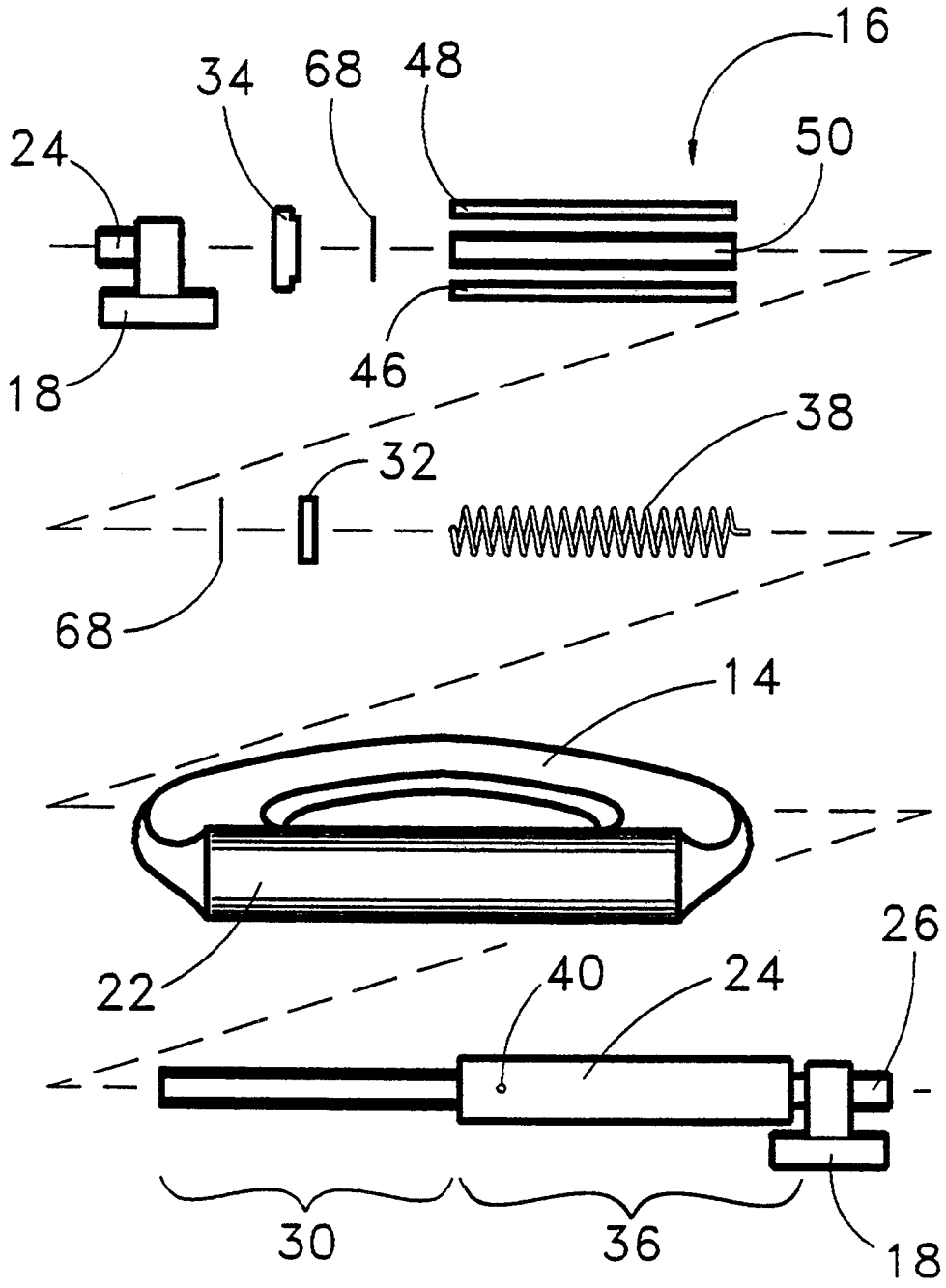
FIG. 6 is an exploded view of the closure assembly in accordance with a preferred embodiment of the invention.
Figure 7A:
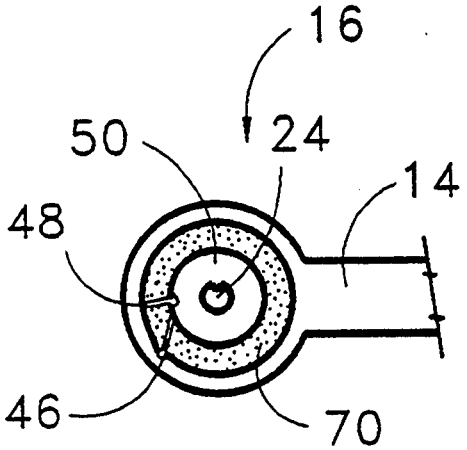
Figure 7D:
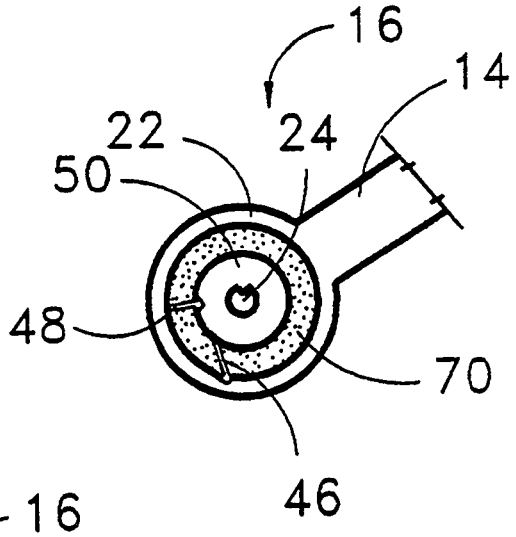
Figure 7B:
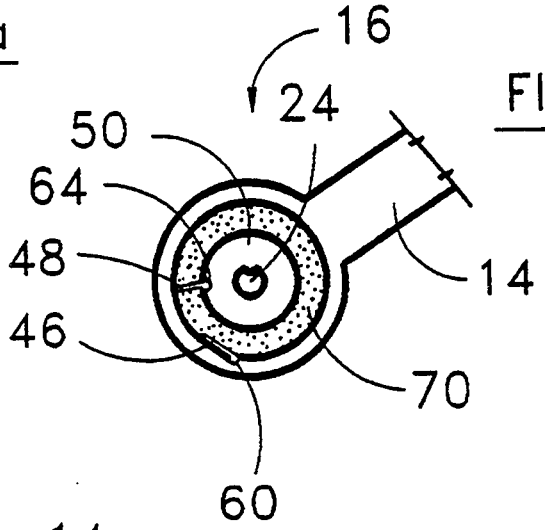
Figure 7C:
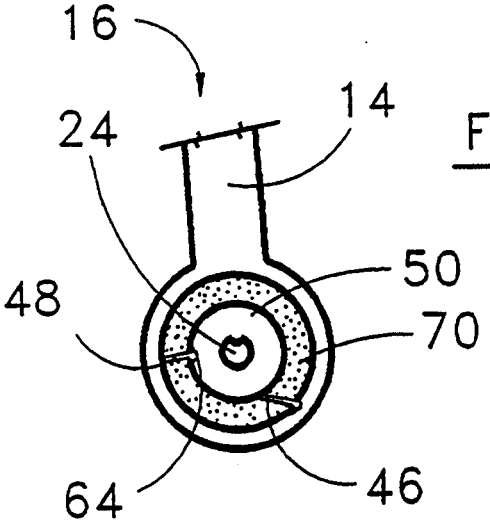
Figure 7E:
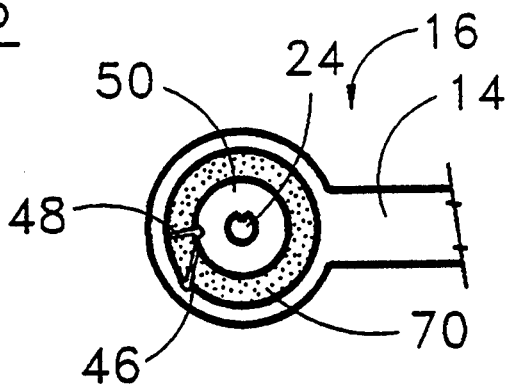

FIG. 6 shows an exploded view of the components of the closure mechanism 16. The left mounting bracket 18 and the stator 24 as well as the left toilet cover hinge pin 26 are preferably molded from a resilient thermoplastic such as polyethylene, or the like, as an integral unit. Each component may, of course, be molded separately and heat welded or adhesively assembled as required. The stator preferably includes two integral cylindrical sections, the dashpot section 30 and the dry spring section 36, the dashpot section 30 being of a smaller diameter to accommodate the relief valve mount 50. This construction facilitates assembly as will be explained below.

The rotor 22 is preferably an integral part of the toilet seat 14. The rotor is a hollow cylinder having a closed left end with a bore for accepting the dry spring section 36 of the stator 24 (see FIG. 4) and an open opposite end for accepting the dashpot end plate 34. The spring 38 is attached to the rotor and the stator as explained above. The dashpot center plate is installed against the free end of the dry spring section 36 and an O-ring 68 is slipped over the dashpot section 30 of the stator shaft. The relief valve mount 50 is slid over the stator shaft 24 after the relief valve 48 is fitted in the anchor cavity 62 in the relief valve mount 50 (see FIG. 5), and the primary valve 46 has been mounted in the anchor cavity 58 in the inner wall of the rotor 22 (see FIG. 5). The fluid reservoir in the dashpot 30 (see FIG. 4) is filled with a damper fluid of an appropriate viscosity, a vegetable oil for example, and a second O-ring 68 is slid over the stator shaft. The dashpot end plate 34 is then attached to the end of the rotor 22 using a threaded connector, an adhesive or some other appropriate method of producing a fluid tight seal. The mounting bracket 18 for the right side is attached to the free end of the stator shaft 24, and assembly of the closure mechanism 16 is complete.

FIGS. *7a–7e* show a typical normal operation sequence of the dashpot section of the closure mechanism 16. FIG. *7a* shows the position of the flap valves when the toilet seat is in a lowered position. In the lowered position, the primary valve 46 and the relief valve 48 are both closed and a damper fluid 70, is at equilibrium. When a user raises the toilet seat 14, a fluid pressure degenerated by the displacement of the primary valve 46 in the damper fluid 70 causes the tension of the primary valve springs 60 to be overridden and the valve opens. Since the relief valve spring 64 is more robust, the relief valve remains closed, as shown in FIG. *7b*. After the seat is moved to the fully raised position shown in FIG. *7c*, the fluid pressure reaches equilibrium and the primary valve 46 returns to a closed condition. When the toilet seat 14 is in the fully raised position shown in FIG. *7c*., the toilet seat rests against the toilet seat cover 12 (see FIG. 1) which in turn generally rests against a front side of the toilet tank (not illustrated). In this position, the energy degenerated in the coil spring 38 (see FIG. 4) acts to urge the toilet seat 14 toward the lowered position. The primary valve 46 and the relief 48 are closed, however, and the damper fluid 70 cannot readily escape from the fluid chamber between the primary valve and the relief valve. Although, as described above, the free edge of the relief valve 48 in its closed position is adjacent the inner edge of the rotor 22, the free edge of relief valve is distanced therefrom by a narrow gap 71. The damper fluid 70 is, therefore, forced slowly through a very narrow gap 71 along the free edge of the relief valve 48. The springs 64 at each end of the relief valve 48 are sufficiently resilient to resist the fluid pressure degenerated by the force exerted by the coil spring 38 so that the relief valve 48 remains in its closed condition. The seat, respectively therefore, respectively remains in the raised position for a period of 1–5 minutes or longer, depending on the viscosity of the damper fluid 70, even though it constantly creeps towards the lowered position.

FIG. *7d* shows the toilet seat after the coil spring 38 has forced the seat past its center of gravity and gravity assists the coil spring in returning the seat to the lowered position. With the assistance of gravity, the damper fluid 70 is forced past the relief valve 48 at a faster rate and the descent of the seat increases so that full closure from that point typically requires about 10–30 seconds, depending on the viscosity of the damper fluid 70.

FIG. *7e* shows the seat returned to the fully lowered position, the damper fluid 70 having reached equilibrium between the closed primary valve 46 and the relief valve 48.

FIGS. *8a–8c* illustrate what occurs when the toilet seat 14 is forced to the lowered position so that the toilet is available for use in a sitting position. Emergency situations may require that a toilet seat be lowered for immediate use. Prior art closure mechanisms generally do not accommodate an override of a damping mechanism. Prior art closure mechanisms may, therefore, be damaged if a toilet seat is forced down in an emergency situation.

Figure 8A:
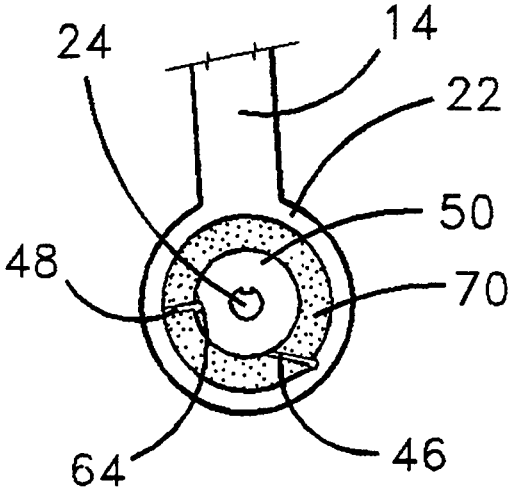
Figure 8B:
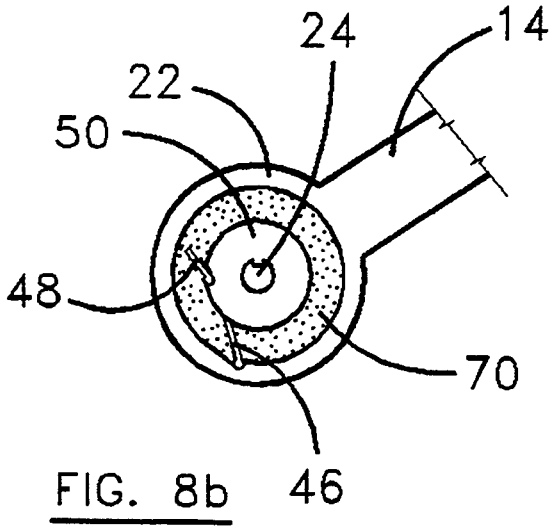
Figure 8C:
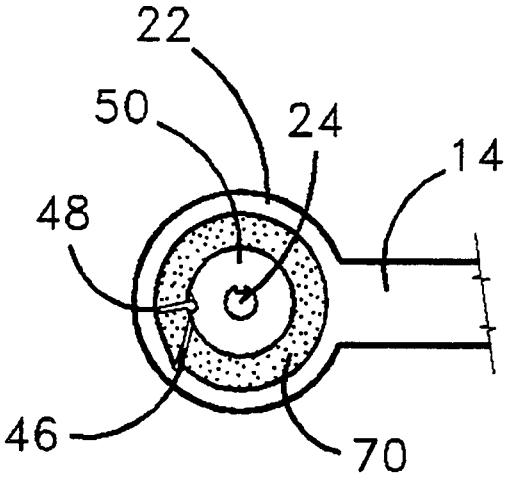

The closure mechanism 16 permits manual override of the closure damper. As shown in FIG. *8a*, the toilet seat 14 is in the raised position. As noted above, closure from this position will normally require about 1–5 minutes, depending on the viscosity of damper fluid 70. The toilet seat may be forcibly lowered, however, by manual override of the damping action of the dashpot 30. FIG. *8b* shows the position of the primary valve 46 and the relief valve 48 when the closure damper is manually overridden. As is apparent, due to the position of primary valve 46, it cannot be forced past the closed condition while the toilet seat is being lowered. The relief valve 48 can, however, be forced to an open condition against the bias of the relief valve springs 64. Manual pressure on the toilet seat 14, therefore, forces the relief valve 48 open and the damper fluid 70 flows readily past the relief valve to permit a user to lower the toilet seat 14 with very little further resistance. Once the toilet seat 14 is in the lowered position shown in FIG. 8*c*, the pressure of the damper fluid 70 between the primary valve 46 and the relief valve 48, is dissipated and the relief valve 48 returns to closed its position.

Although the preferred embodiment of the invention has been described above with reference to a specific toilet seat construction, it will be understood by those skilled in the art that the principles described may be applied to other closures and constructions not described above. The scope of the invention is therefore intended to be limited solely by the scope of the appended claims.

We claim:

1. A dashpot mechanism with damping capability for controlling movement of a pivotable toilet seat assembly to permit the toilet seat assembly to be pivoted to a raised position with little resistance while ensuring that the toilet seat assembly returns to a lowered position by a controlled closing action, unless the controlled closing action is overridden, in which case the toilet seat assembly may be forcibly returned to a closed condition without damaging either of the dashpot and the toilet seat assembly, said dashpot mechanism comprising:

a stator and a cylindrical rotor rotatably received on the stator, the rotor being adapted for connection with the toilet seat assembly and the rotor and the stator defining a fluid tight reservoir containing a damper fluid;

a first flap valve and a second flap valve spaced-apart from each other and positioned in the fluid tight reservoir to define a first fluid chamber and a second fluid chamber;

the first flap valve being hingedly mounted to an inner wall of the rotor, the first flap valve having a free edge and being adapted to rotate between a closed condition, wherein the free edge contacts a wall of the stator, and an open condition, wherein the free edge is spaced from the wall of the stator;

the second flap valve being hingedly mounted to the wall of the stator, the second flap valve having a free edge and being adapted to rotate between a closed condition, wherein the free edge of the second flap valve is adjacent the wall of the rotor, to an open condition, wherein the free edge is spaced from the wall of the rotor; and means for respectively urging the first flap valve and the second flap valve to their closed conditions, whereby when the toilet seat assembly is pivoted to the raised position, the first flap valve is forced to an open condition by fluid pressure generated by the damper fluid and the toilet seat may be raised with little resistance, and when the pivotable toilet seat assembly is moved toward a lowered position, the first flap valve and the second flap valve resist movement of the damper fluid and closure movement of the toilet seat is resisted so that the toilet seat lowers in a controlled manner, but when the toilet seat is forced to a lowered position by a manual override, the fluid pressure generated in the damper fluid by the manual override forces the second flap valve to the open condition to permit the toilet seat to be lowered with little additional resistance and without damage to any one of the pivotable toilet seat assembly and the dashpot.

2. The dashpot mechanism with damping capability as claimed in claim 1 wherein the first flap valve and the second flap valve are respectively hingedly mounted by an anchor bulb along an edge opposite the free edge, the anchor bulb of the first flap valve being received in an anchor cavity in the inner wall of the rotor, and the anchor bulb of the second flap valve being received in an anchor cavity in the wall of the stator.

3. The dashpot mechanism with damping capability as claimed in claim 2 wherein the means for respectively urging the first flap valve and the second flap valve to their closed conditions comprise torsion springs attached to opposite sides of each flap valve, the torsion springs being biased to force respective flap valves to their closed condition.

4. An apparatus for automatically closing a seat member for a toilet bowl, said apparatus comprising:

a hollow cylindrical rotor adapted for connection to the seat member for rotation with the seat member from a lowered position wherein the seat member rests on a top edge of the toilet bowl to a raised position wherein the seat member is at an obtuse angle with respect to the top edge of the toilet bowl;

a stator having opposite ends, the stator extending axially through the rotor and the opposite ends being mountable to brackets for supporting a rear edge of the seat member;

energy storage means associated with the rotor and the stator for urging the seat member to the lowered position after the seat member has been manually rotated from the lowered position;

means for defining a fluid tight reservoir within a portion of the rotor;

a first flap valve and a second flap valve located in the fluid tight reservoir, the first flap valve being hingedly mounted to an outer surface of the stator and the second flap valve being hingedly mounted to an inner surface of the rotor so that the fluid tight reservoir is partitioned into a first fluid chamber and a second fluid chamber when the first flap valve and the second flap valve are in a closed condition, the first flap valve and the second flap valve being respectively provided with means for urging the first flap valve and the second flap valve to their closed condition; and a damper fluid filling the first fluid chamber and the second fluid chamber, whereby when the seat member is rotated to the raised position, the first flap valve is forced open by damper fluid pressure and the seat is rotated to the raised position with little resistance, and when the energy storage means urges a seat member to the lowered position, the first flap valve and the second flap valve resist movement of the damper fluid permitting the seat to close slowly, but when the seat member is forced to the lowered position, the second flap valve is opened by fluid pressure and the seat is moved to the lowered position with little additional resistance.

5. The apparatus for automatically closing a seat member for a toilet bowl as claimed in claim 4 wherein the first flap valve and the second flap valve are respectively hingedly mounted by an anchor bulb along a bottom edge, the anchor bulb of the first flap valve being rotatably received in an anchor cavity formed in an inside surface of the rotor and the anchor bulb of the second flap valve being rotatably received in an anchor cavity formed in an outer surface of the stator so that the fluid tight reservoir is divided into the first fluid chamber and the second fluid chamber when the respective valves are in the closed condition.

6. The apparatus for automatically closing a seat member for a toilet bowl as claimed in claim 4 wherein the means for defining a fluid tight reservoir within a portion of the rotor comprises a first disc and a second disc having an axial bore for slidably receiving the stator, the first disc and the second disc being adapted to be engageable with the rotor to form a fluid tight seal, and a pair of O-rings for respectively providing a seal between the first disc and the second disc, and the stator.

7. The apparatus for automatically closing a seat member for a toilet bowl as claimed in claim 4 wherein the energy storage means associated with the rotor and the stator for urging the seat member to the lowered position comprises a coil spring mounted on the stator, the coil spring having a first end attached to the stator and a second end attached to the rotor.

8. The apparatus for automatically closing a seat member for a toilet bowl as claimed in claim 4 wherein the damper fluid comprises an oil.

9. The apparatus for automatically closing a seat member for a toilet bowl as claimed in claim 8 wherein the oil comprises a vegetable oil.

10. An automatically closing seat member for a toilet bowl, said automatically closing seat member comprising:

a hollow cylindrical rotor integral with a rear end of the seat member;

a stator having opposite ends, the stator extending axially through the rotor and the opposite ends being mountable to brackets for supporting a rear edge of the seat member;

a coil spring disposed on the stator and connected respectively with the rotor and the stator for urging the seat member to a lowered position after the seat member has been rotated to a raised position;

opposed sealed partitions for defining a fluid tight reservoir within a portion of the hollow cylindrical rotor to one side of the coil spring;

a first flap valve and a second flap valve spaced-apart from each other and located in the fluid tight reservoir so that the fluid tight reservoir is divided into a first fluid chamber and a second fluid chamber when the first flap valve and the second flap valve are in a closed condition, the first flap valve and the second flap valve respectively including top and bottom edges with an anchor bulb along the bottom edge;

the anchor bulb of the first flap valve being rotatably received in an anchor cavity formed in an inside surface of the rotor and the first flap valve being rotatable from a closed condition wherein the top edge of the first flap valve contacts a wall of the stator to an open condition wherein the top edge of the first flap valve does not contact the wall of the stator;

the anchor bulb of the second flap valve being rotatably received in an anchor cavity formed in the wall of the stator and the second flap valve being rotatable from a closed condition wherein the top edge of the second flap valve is adjacent the wall of the rotor to an open condition wherein the top edge of the second flap valve is spaced from the wall of the rotor;

means for urging the first flap valve and the second flap valve to the closed condition; and a damper fluid filling the first fluid chamber and the second fluid chamber, whereby when the seat member is rotated to the raised position, the first flap valve is forced to the open position by damper fluid pressure and the seat may be rotated to the raised position with little resistance, and when the coil spring urges the seat member toward a lowered position, the seat closes slowly because the first flap valve and the second flap valve resist movement of the damper fluid, but when the seat member is forcibly returned to the lowered position, the second flap valve is forced to the open position by damper fluid pressure and the seat is lowered with little additional resistance.

11. The automatically closing seat member for a toilet bowl as claimed in claim 10 wherein the brackets for supporting a rear edge of the seat member include hinge pins for supporting a toilet seat cover for the seat member.

12. The automatically closing seat member for a toilet bowl as claimed in claim 10 wherein the means for urging the first flap valve and the second flap valve to a closed condition comprises torsion springs respectively mounted to opposite sides of the first flap valve and the second flap valve.

13. The automatically closing seat member for a toilet bowl as claimed in claim 12 wherein the torsion springs for urging the first flap valve to a closed condition are less robust than the torsion springs for urging the second flap valve to the closed condition.

14. The automatically closing seat member for a toilet bowl as claimed in claim 10 wherein the anchor cavity for receiving the second flap valve is formed in a cylindrical mount which is slidably mounted to the stator to facilitate assembly of the apparatus.

15. The automatically closing seat member for a toilet bowl as claimed in claim 10 wherein the damper fluid filling the first fluid chamber and the second fluid chamber comprises an oil.

16. The automatically closing seat member for a toilet bowl as claimed in claim 15 wherein the oil comprises a vegetable oil.

* * * * *

UNITED STATES PATENT AND TRADEMARK OFFICE

CERTIFICATE OF CORRECTION

PATENT NO. : 5,388,281
DATED : February 14, 1995
INVENTOR(S) : Ken Wiklund

It is certified that error appears in the above-indentified patent and that said Letters Patent is hereby corrected as shown below:

In claim 4, column 10, line 40, change "first" to --second-- before flap valve.

In claim 4, column 10, line 42, change "second" to --first-- before flap valve.

Signed and Sealed this

First Day of September, 1998

*Attest:*

*Attesting Officer*

BRUCE LEHMAN

*Commissioner of Patents and Trademarks*